US011231000B2

(12) United States Patent
Geyer

(10) Patent No.: US 11,231,000 B2
(45) Date of Patent: Jan. 25, 2022

(54) MULTI-PART ROLLER TAPPET

(71) Applicant: Schaeffler Technologies AG & Co. KG, Herzogenaurach (DE)

(72) Inventor: Norbert Geyer, Hochstadt (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 302 days.

(21) Appl. No.: 16/499,635

(22) PCT Filed: Feb. 1, 2018

(86) PCT No.: PCT/DE2018/100077

§ 371 (c)(1),
(2) Date: Sep. 30, 2019

(87) PCT Pub. No.: WO2018/184620

PCT Pub. Date: Oct. 11, 2018

(65) Prior Publication Data

US 2020/0041018 A1 Feb. 6, 2020

(30) Foreign Application Priority Data

Apr. 3, 2017 (DE) ..... 102017107099.0

(51) Int. Cl.
*F02M 59/10* (2006.01)

(52) U.S. Cl.
CPC ..... *F02M 59/102* (2013.01)

(58) Field of Classification Search
CPC ..... F01L 1/143; F02M 59/102
USPC ..... 123/508, 90.48
See application file for complete search history.

(56) References Cited

U.S. PATENT DOCUMENTS

| | | | | |
|---|---|---|---|---|
| 3,108,580 | A | 10/1963 | Crane, Jr. | |
| 3,977,370 | A | 8/1976 | Humphreys | |
| 5,379,730 | A | 1/1995 | Schaeffler | |
| 9,556,754 | B2 | 1/2017 | Hattiangadi et al. | |
| 2008/0190237 | A1* | 8/2008 | Radinger | F01L 1/143 74/569 |
| 2009/0314236 | A1* | 12/2009 | Meisborn | F01L 1/18 123/90.48 |

(Continued)

FOREIGN PATENT DOCUMENTS

| | | |
|---|---|---|
| AT | 515737 | 11/2015 |
| CN | 103917769 | 7/2014 |

(Continued)

*Primary Examiner* — Jorge L Leon, Jr.
(74) *Attorney, Agent, or Firm* — Volpe Koenig

(57) ABSTRACT

A roller tappet, in particular for a high-pressure fuel pump, is provided that is guided in the direction of the longitudinal axis thereof in a housing receptacle and is driven translatably in the longitudinal direction by cams of a camshaft. The roller tappet has a tappet body. This tappet body has a tappet skirt, a pump piston contact point (9), and a rotatably mounted roller (4), by which the roller tappet is supported on the camshaft. The tappet body has a guide cylinder (1), which is mounted in the housing receptacle and on which the roller (4) is supported, and a cup-shaped sleeve (7) having the pump piston contact point (9), which cup-shaped sleeve is supported in the guide cylinder (1) by a radial ring (8). A cylindrical constriction (5) is formed in the guide cylinder (1) in the region of the radial ring support.

8 Claims, 1 Drawing Sheet

(56) References Cited

U.S. PATENT DOCUMENTS

| | | | | |
|---|---|---|---|---|
| 2012/0294741 | A1* | 11/2012 | Nishimura | F04B 1/0426 417/437 |
| 2016/0160695 | A1 | 6/2016 | Hattiangadi et al. | |
| 2016/0222934 | A1 | 8/2016 | Oki | |

FOREIGN PATENT DOCUMENTS

| | | |
|---|---|---|
| CN | 203532125 | 4/2019 |
| DE | 2540061 | 5/1976 |
| DE | 4128813 | 3/1993 |
| DE | 4325610 | 2/1995 |
| DE | 102006031032 | 1/2008 |
| DE | 102008000710 | 9/2009 |
| DE | 102011075478 | 11/2012 |
| DE | 102012223413 | 6/2014 |
| DE | 102014214900 | 2/2016 |
| DE | 102015117364 | 8/2016 |
| EP | 0767291 | 4/1997 |
| GB | 1294122 | 10/1972 |

* cited by examiner

MULTI-PART ROLLER TAPPET

CROSS-REFERENCE TO RELATED APPLICATIONS

This application is a 371 National Phase of PCT/DE2018/100077, filed Feb. 1, 2018, which claims the benefit of German Patent Application No. 10 2017 107 099.0, filed Apr. 3, 2017, both of which are incorporated by reference herein as if fully set forth.

BACKGROUND

The disclosure relates to a multi-part roller tappet for a high-pressure fuel pump, which is guided in the direction of its longitudinal axis in a housing receptacle and is driven displaceably in the longitudinal direction by cams of a camshaft, with a tappet body comprising a tappet skirt, a pump piston contact point and a rotatably mounted roller, via which the roller tappet is supported on the camshaft.

Such a roller tappet is known from DE 10 2012 223 413. The roller tappet is formed as an integral unit designed for a special high-pressure fuel pump. If the distance between the camshaft and the pump unit varies, the tappet must be produced with different dimensions. This also applies to elongations of the tappet skirt. Such modifications are however costly.

Also, publications DE 25 40 061 A1, AT 515 737 A1, U.S. Pat. No. 9,556,754 B2, EP 0 767 291 A1, U.S. Pat. No. 3,108,580 A and DE 41 28 813 A1 describe multi-part roller tappets which all have a generally cylindrical, hollow guide cylinder having a roller at the axial end for running on a driving shaft, and a cup-shaped sleeve which is attached in the guide cylinder and, remote from the roller, has a contact face for a pump piston. Some of these known guide cylinders have a cylindrical constriction at their radially outer casing surface, so that, to avoid deformation of this constricted region, either the cup-shaped sleeve is attached in the guide sleeve axially outside the constriction, or the wall thickness of the cylinder is so great that, for example, pressing in the cup-shaped sleeve does not cause any change in the dimensions or geometry of the outer casing surface of the respective guide cylinder. However, a comparatively great wall thickness leads to a larger moving mass of the roller tappets, which is considered disadvantageous.

SUMMARY

The disclosure is based on the object of providing a multi-part roller tappet which is constructed such that the fixing of a cup-shaped sleeve in its guide cylinder leads to no disadvantageous changes in the outer geometry and external dimensions of the guide cylinder. Also, the roller tappet can be adapted to various installation lengths and distances between the camshaft and the pump element. Also, it is guided with a precise fit in the housing receptacle irrespective of thermal and component-induced deformations.

This object is achieved with the above-mentioned tappet body in that the tappet body has a guide cylinder which is mounted in the housing receptacle and on which the roller is supported, the tappet body has a cup-shaped sleeve having a pump piston contact point and arranged inside the guide cylinder, and between its axial ends, the sleeve has a radially outwardly oriented radial ring, the guide cylinder has a cylindrical constriction, a constriction groove is stamped inside the constriction of the guide cylinder, and the radial ring of the cup-shaped sleeve is attached to the inner casing of the constriction groove.

With this design, a constriction groove is provided inside the cylindrical constriction which protrudes even further inward in the direction of the cup-shaped sleeve and is also stamped inwardly. This constriction groove has the advantage that only a narrow casing region inside the guide cylinder need be finely machined for the radial ring to have the correct fit. The constriction is important both in a guide cylinder whose length reaches from the roller only to the edge of the radial ring, and also if the guide cylinder has a further cylinder facing away from the roller.

Accordingly, the cup-shaped sleeve can easily be attached to the inner casing surface of the guide cylinder without any danger of the fixing process adversely affecting the geometry and dimensions of the cylindrical constriction of the guide cylinder. This is achieved by forming said constriction groove in the region of the cylindrical constriction of the guide cylinder, on the inner casing surface of which the cup-shaped sleeve is attached. If a plastic deformation occurs, this is formed only in the region of the constriction groove and not however in the cylindrical constriction of the guide cylinder or in the remaining outer casing surface.

The cylindrical constriction in the guide cylinder, however, has the advantage that an expansion of the guide cylinder in this region, resulting from the support of the radial ring on the guide cylinder, in particular because of a press-fit joint, remains inside the outer dimensions of the guide cylinder so there is no increase in friction and no seizing of the guide cylinder in the housing receptacle. This constriction ensures that expansion is possible without exceeding the casing surface. The constriction should therefore have a depth and axial extent such that the widening lies inside the remaining casing surface(s) of the guide cylinder. The respective component stiffness and the required overlap of the press-fit seat can be taken into account here. The constriction may advantageously be created by means of rolling.

Because of its two-part design, the roller tappet is variable in tappet length and also variable with regard to the guide cylinder, which can then also be adapted to the respective tappet length.

DETAILED DESCRIPTION

Figure 3:
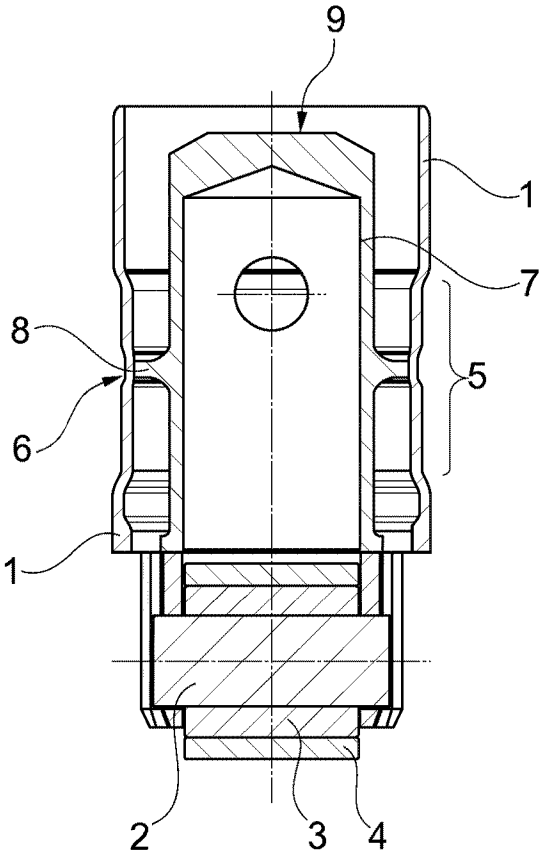
FIG. 3 shows a section through the roller tappet which is rotated through 90° relative to FIG. 2.
Figure 2:
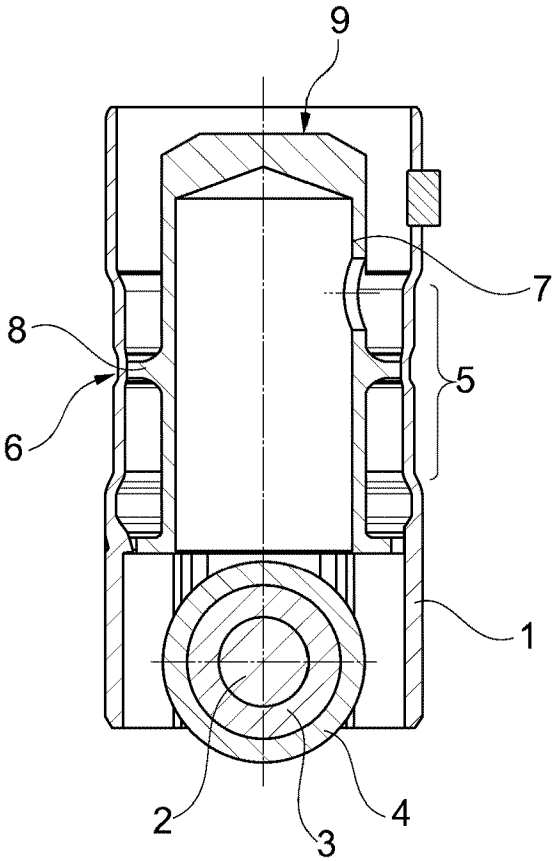
FIG. 2 shows the section through the roller tappet with a cross-section through the roller.
Figure 1:
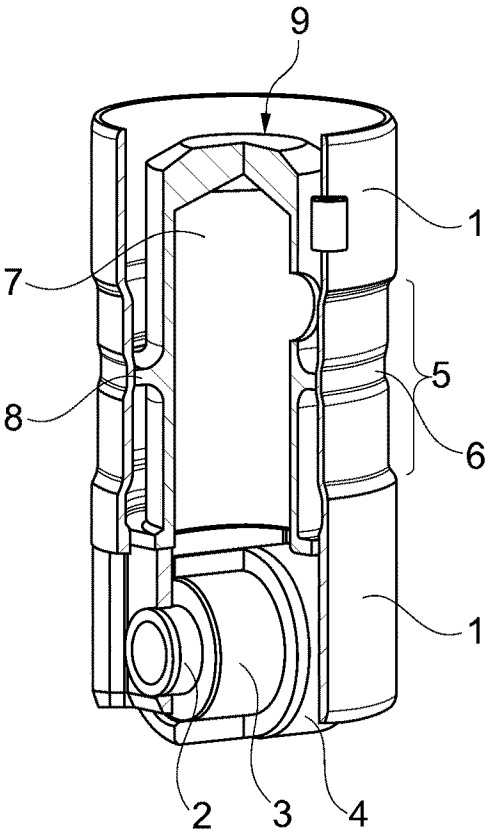
FIG. 1 shows a perspective exterior view of a roller tappet with a partial section through the tappet.

In FIGS. 1 to 3, reference sign 1 designates a guide cylinder, on which a pin 2 is pivotably mounted; said pin supports a bearing sleeve 3 which in turn supports a roller 4. In its casing region, the guide cylinder 1 has a constriction 5 which can be produced by rolling. Furthermore, a constriction groove 6 is machined, either by stamping or also by rolling, into the constriction and hence also extends inwardly. A cup-shaped sleeve 7 is inserted in the guide cylinder 1 and, in addition to a longitudinal support on the guide cylinder 1 in the region of the roller 4, has a radial ring 8, the outer surface of which is fitted precisely into the finely machined inner casing of the constriction groove 6. At its end facing away from the roller 4, the cup-shaped sleeve 7 furthermore has a pump piston contact point 9 which, in its shape and strength, is adapted to the forces for the pump piston. The radial ring 8 may be pressed, welded, glued or otherwise attached in the inner casing of the constriction groove 6. The constriction 5, in conjunction with the support of the radial ring 8 on the constriction groove 6, receives a component deformation within the constriction 5 which remains inside the casing of the guide cylinder 1.

LIST OF REFERENCE SIGNS

1) Guide cylinder
2) Pin
3) Bearing sleeve
4) Roller
5) Constriction
6) Constriction groove
7) Cup-shaped sleeve
8) Radial ring
9) Pump piston contact point

The invention claimed is:

1. A roller tappet for a high-pressure fuel pump, which is adapted to be guided in a longitudinal direction of the roller tappet in a housing receptacle and is adapted to be driven displaceably in the longitudinal direction by cams of a camshaft, the roller tappet comprising:

a guide cylinder adapted to be received in the housing receptacle, the guide cylinder including a tappet skirt and a cylindrical constriction, a cup-shaped sleeve arranged inside the guide cylinder, the sleeve including a pump piston contact point and a radially outwardly projecting radial ring, and a roller rotatable mounted to the guide cylinder, the roller arranged at least partially within the tappet skirt, wherein:

the roller tappet is supported on the camshaft via the roller, the cylindrical constriction includes a constriction groove, and the radial ring is attached to an inner surface of the guide cylinder at a location corresponding to the constriction groove.

2. The roller tappet as claimed in claim 1, wherein the radial ring is attached to the inner surface via an interference fit, and wherein an increased outer diameter of the cylindrical constriction, caused by the interference fit, is less than a maximum outer diameter of the guide cylinder.

3. The roller tappet as claimed in claim 1, wherein the constriction groove is stamped inside the cylindrical constriction.

4. A roller tappet for a high-pressure fuel pump, the roller tappet comprising:

a guide cylinder adapted to be received in a housing receptacle, the guide cylinder including a cylindrical constriction, a roller rotatably supported on the guide cylinder, the roller adapted to contact a cam, and a cup-shaped sleeve arranged inside the guide cylinder, the sleeve including a pump piston contact point and a radially outwardly projecting radial ring, wherein the cylindrical constriction includes a constriction groove, and wherein the radial ring of the cup-shaped sleeve is attached to an inner surface of the guide cylinder at a location corresponding to the constriction groove.

5. The roller tappet of claim 4, wherein the radial ring is attached to the inner surface at the constriction groove via an interference fit.

6. The roller tappet of claim 5, wherein an increased outer diameter of the cylindrical constriction, caused by the interference fit, is less than a maximum outer diameter of the guide cylinder.

7. The roller tappet of claim 4, wherein the cylindrical constriction is located at a medial position of the guide cylinder.

8. The roller tappet of claim 4, wherein the roller is located at least partially within the guide cylinder.

* * * * *